United States Patent [19]

Komori

[11] Patent Number: 4,848,265

[45] Date of Patent: Jul. 18, 1989

[54] PRINTING APPARATUS HAVING COATING FUNCTION

[75] Inventor: Tatsuo Komori, Toride, Japan

[73] Assignee: Komori Printing Machinery Co., Ltd., Tokyo, Japan

[21] Appl. No.: 130,011

[22] Filed: Dec. 8, 1987

[30] Foreign Application Priority Data

Jan. 30, 1987 [JP] Japan ..... 62-018689

[51] Int. Cl.[4] ..... B05C 11/00

[52] U.S. Cl. ..... 118/46; 101/76; 101/216; 101/349; 101/DIG. 49

[58] Field of Search ..... 118/46; 101/76, 77, 101/72, 217, 232, 247, 248, 349, DIG. 28, 152, 153, 179, 216, 375, 376, 377, 328, 331, 330, 329

[56] References Cited

U.S. PATENT DOCUMENTS

| | | | |
|---|---|---|---|
| 2,751,843 | 6/1956 | Faeher | 101/349 |
| 3,054,346 | 9/1962 | Koch et al. | 101/247 X |
| 3,093,070 | 6/1963 | Beaver | 101/376 |
| 3,721,188 | 3/1973 | Jacobsen et al. | 101/375 |
| 3,728,960 | 4/1973 | Heath | 101/216 X |
| 4,024,812 | 5/1977 | Jahn | 101/76 |
| 4,207,815 | 6/1980 | Watanabe | 101/248 |
| 4,369,703 | 1/1983 | Jarach | 101/76 |

FOREIGN PATENT DOCUMENTS

| | | | |
|---|---|---|---|
| 1285553 | 8/1972 | United Kingdom | 101/DIG. 28 |
| 2132559 | 7/1984 | United Kingdom | 101/179 |
| 2173740 | 10/1986 | United Kingdom | 101/DIG. 28 |

*Primary Examiner*—Clifford D. Crowder

*Attorney, Agent, or Firm*—Rosen, Dainow & Jacobs

[57] ABSTRACT

A printing apparatus which is provided with an integral rotary shaft supported on the main unit's frames, a numbering device, a relief imprinting cylinder, and a coating cylinder which are detachably and alternatively mounted on the rotary shaft from its periphery, and an ink unit and a coater unit, thereby enabling coating operations as need in addition to numbering and imprinting operations.

5 Claims, 6 Drawing Sheets

PRINTING APPARATUS HAVING COATING FUNCTION

BACKGROUND OF THE INVENTION

1. Field of the Invention

This invention relates to a printing apparatus which enables coating operation as needed in addition to numbering and imprinting.

2. Description of the Prior Art

Printed matters which require a good-looking appearance such as book covers, catalogs, and pamphlets are often coated with a varnish which forms a film on the printed paper to prevent the surface from staining and give it a gloss. The coating operation may be performed by an independent device (coater), but in many cases it is carried out by a coater provided in a delivery passage of a printing apparatus to perform the coating operation immediately following the print operation for improved working efficiency.

On the other hand, in some cases, a numbering and imprinting device is provided in the delivery passage of the printing apparatus for partial imprinting or numbering. In the numbering and imprinting device, a numbering device can be attached to a printing shaft to perform numbering, or a relief imprinting cylinder in place of the numbering device can be attached to the printing shaft to perform imprinting.

In prior art printing presses, the coater or the numbering and imprinting device is provided as an independent device.

As described above, since the coater and the numbering and imprinting device are separate devices in the prior art printing presses, both devices must be installed when a coating operation is required in addition to numbering and imprinting operations, which result in an increase in equipment cost and installation space.

When one designs a printing apparatus that can perform the coating operation in addition to the numbering and imprinting operation, there occur the following problems. The printing shaft of the numbering and imprinting device is normally divided into shaft supporting sections at both ends of the shaft and a central section to support the numbering device or the like, in order to facilitate attaching and detaching of the numbering device or an relief imprinting cylinder to and from the printing shaft and cleaning of an impression cylinder which is located at the rear side of the printing shaft. Thus, only the central section of the printing shaft can be removed from the printing apparatus, and the numbering device or the relief imprinting cylinder can be attached to the removed central section of the printing shaft, thereby facilitating attaching the device. Further, the removal of the central section of the printing shaft results in a space in the printing apparatus, which facilitates cleaning the inside of the printing apparatus. However, since the central section of the shaft is detachably mounted on the shaft supporting sections with retaining means such as bolts, the central section can possibly be mounted eccentrically relative to the shaft supporting sections with restricted mounting accuracy. For the case of the coater, a coating cylinder to coat a varnish or the like on the print paper in combination with the impression cylinder is required to make exact rotation. If the coating cylinder rotates eccentrically, the distance between the coating cylinder surface and the impression cylinder varies as it turns with a variation in contact pressure, which results in uneven thickness of the coating layer. Since a quick-drying type varnish is used, all of the varnish supplied to the coating cylinder must be transferred to the paper surface. However, if there is an eccentric rotation of the coating cylinder, flow of the varnish is interrupted and the varnish hardens on the coating cylinder, which results in increased unevenness greater than due to the eccentric rotation of the coating cylinder. Therefore, printed matter with enhanced gloss cannot be obtained. As compared with numbering, coating requires an increased printing pressure. However, if the central section of the printing shaft is fastened with a bolt, the central section is liable to shift in the direction perpendicular to the axis of the bolt, which results in an increased eccentricity and vibration. Therefore, it is practically impossible to attach the coating cylinder to the central section of the printing shaft.

Further, since normally the prior art coating cylinder has been integrally combined with the shaft supporting sections, the whole frames supporting the coating cylinder must be dismantled to remove the coating cylinder, which has made it difficult to remove and replace the coating cylinder.

SUMMARY OF THE INVENTION

With a view to obviate all of the prior art defects of printing presses, it is a primary object of the present invention to provide a printing apparatus which can perform coating operation in addition to numbering and imprinting.

In accordance with the present invention which attains the above object, there is provided a printing apparatus having a coating function, comprising in the vicinity of an impression cylinder an integral rotary shaft supported at its both ends on frames of a printing apparatus main unit and driven to rotate in synchronization with the impression cylinder, a numbering device, a relief imprinting cylinder and a coating cylinder, which are selectively and detachably mounted on the peripheral surface of the rotary shaft and operating in combination with the impression cylinder, an ink unit detachably mounted on the printing apparatus main unit for supplying ink to the numbering device or the relief imprinting cylinder, and a coater unit detachably mounted, alternatively to the ink unit, on the printing apparatus main unit for supplying the coating cylinder with a coating material.

For number printing with the printing apparatus according to the present invention having the above-described arrangement, the numbering device is mounted on the rotary shaft and the ink unit is installed on the printing apparatus main unit. The numbering device is supplied with ink from the ink unit to print a number on matter to be printed on which is inserted between the numbering device and the impression cylinder. Imprinting is performed using the relief imprinting cylinder in place of the numbering device, which is attached to the rotary shaft. For coating operation, the coating cylinder is mounted on the rotary shaft and the coater unit is installed on the printing apparatus main unit. The coating cylinder is supplied with the coating material from the coater unit, and the coating material is coated on the matter to be printed which is inserted between the coating cylinder and the impression cylinder.

Other and further objects of this invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

Figure 1:
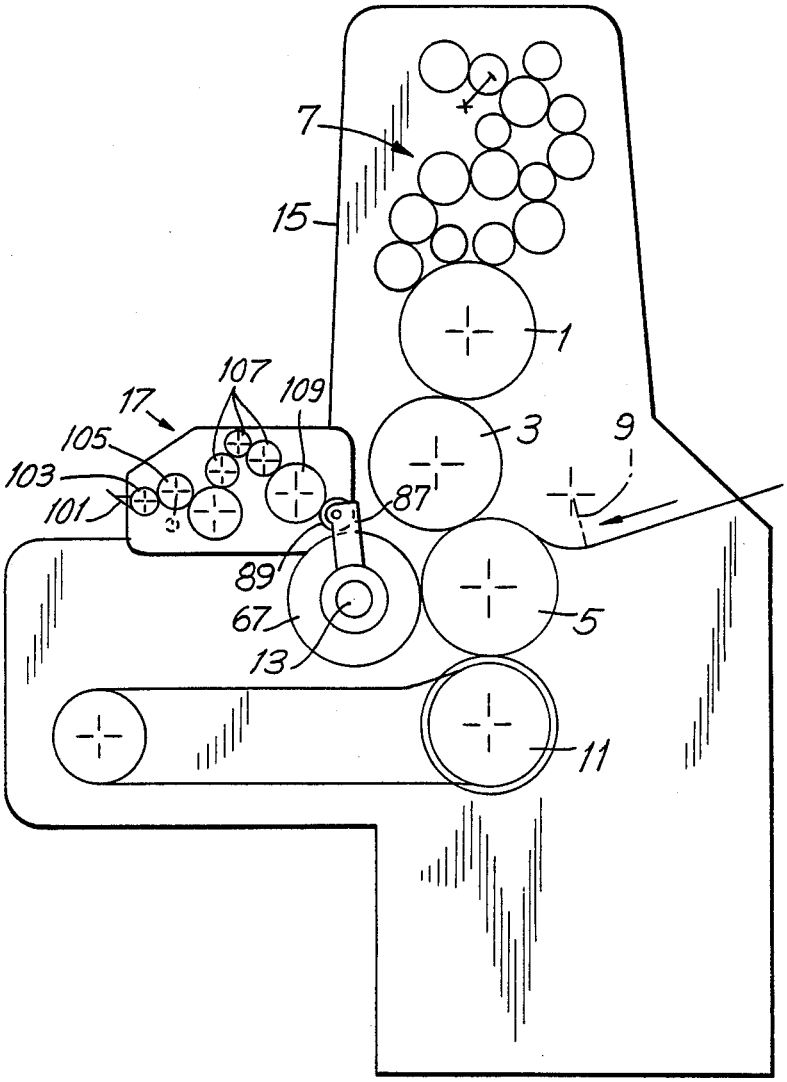
FIG. 1 is a schematic view of an embodiment of the sheet-feed offset printing apparatus according to the present invention.
Figure 7:
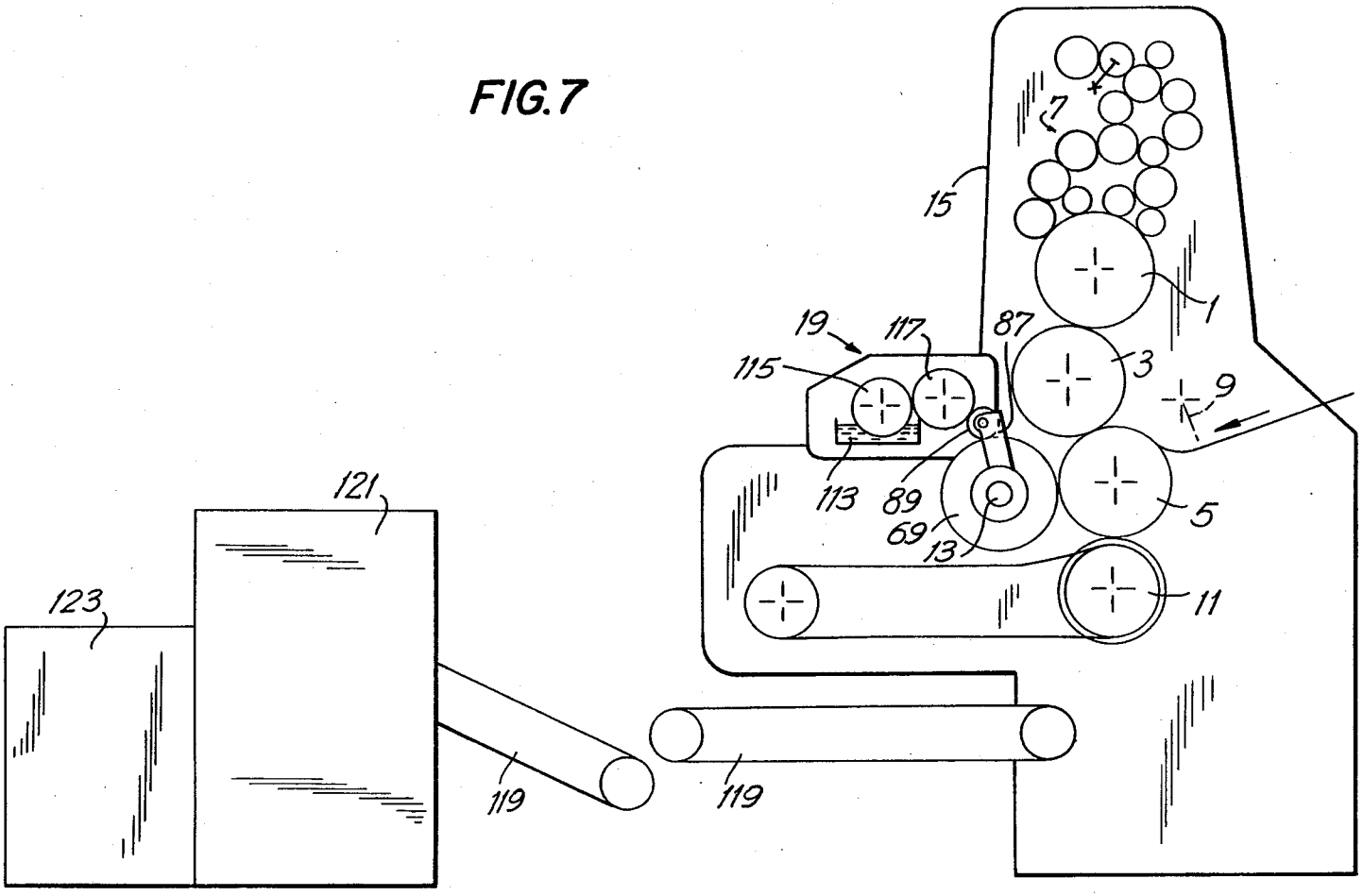
FIG. 7 is a schematic view of the printing apparatus according to the present invention which is set up for coating operation.

An embodiment of the present invention when applied to a printing apparatus will be described with reference to the drawings. Referring to FIG. 1, numeral 1 indicates a plate cylinder, numeral 3 indicates a blanket cylinder, number 5 indicates an impression cylinder, numeral 7 indicates an ink feeder for plate cylinder, number 9 indicates a sheet feeder, and numeral 11 indicates a sheet discharger. A line pattern transferred from the plate cylinder 1 to the blanket cylinder is imprinted on a sheet of paper supplied from the sheet feeder 9 into between the blanket cylinder 3 and the impression cylinder 5, and the printed sheet is discharged by the sheet discharger 11. In a sheet discharge passage between the impression cylinder 5 and the sheet discharger 11, a rotary shaft 13 is disposed adjacent to the impression cylinder 5, which is commonly used for numbering, imprinting, and coating. An ink unit 17 is detachably mounted opposing the rotary shaft 13 on a printing apparatus main unit 15. The mounting location of the ink unit 17 on the printing apparatus main unit 15 can be detachably mounted with a coater unit 19 which will be described later herein, alternatively to the ink unit 17 (FIG. 7).

Figure 3:
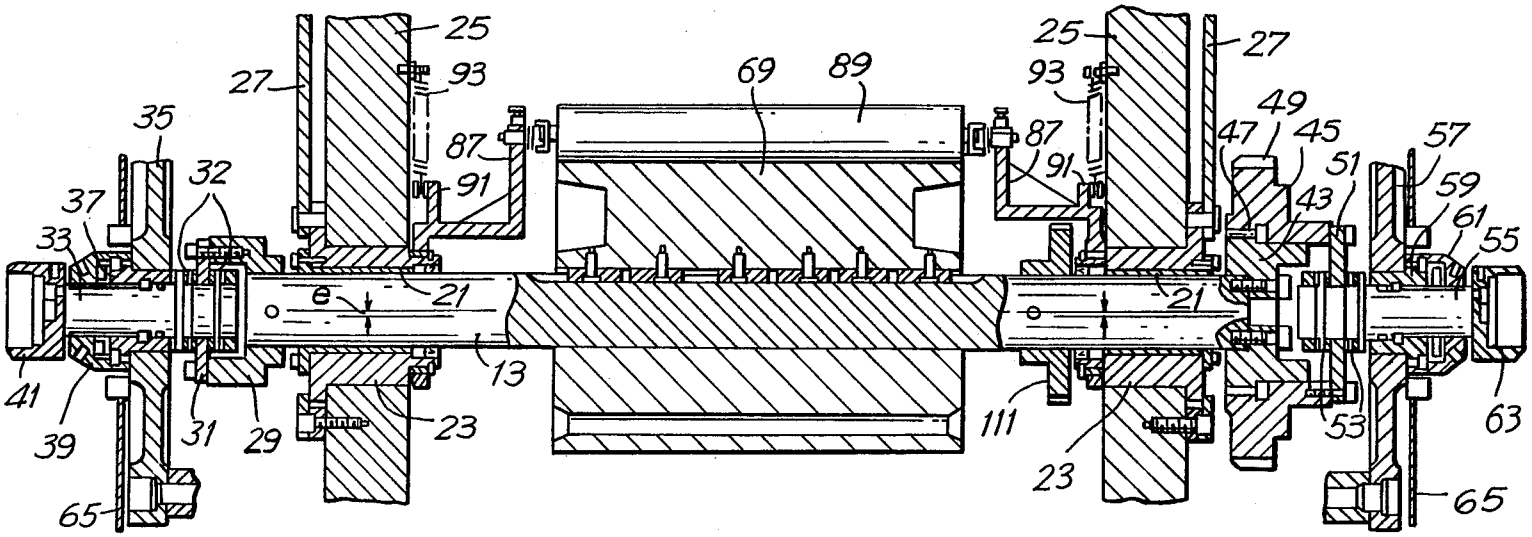
FIG. 3 is a schematic vertical sectional view of a rotary shaft provided with a coating cylinder.

As shown in FIG. 3, the rotary shaft 13 is an integrally formed cylinder, supported at its both ends by eccentric bushings 23 through bearing metals 21, and the eccentric bushings 23 are supported by main unit frames 25. The eccentric bushings 23 are rotatably supported by the main unit frames 25 and have an eccentricity e between the center of the inner peripheral surfaces of the bushings 23 contacting with the bearing metals 21 and the center of the outer peripheral surfaces contacting with the main unit frames 25, thereby allowing movement of the axial center position of the rotary shaft 13 by changing the phase angle of the eccentric bushings 23 through rods 27 mounted on the eccentric bushings 23. Thus, by turning the eccentric bushings 23, the rotary shaft 13 is moved and the distance between axial centers of the rotary shaft 13 and the impression cylinder 5 is adjusted for adapting for the thickness of paper to be printed and withdrawal of the rotary shaft 13 in the event of a malfunction. The rotary shaft 13 can be removed and inserted in the axial direction with the bearing metals 21 attached to the main unit frames 25. The central part of the rotary shaft 13 other than its both ends supported by the bearings has a smaller diameter by more than its fitting tolerance than the inner diameter of the bearing metals 21. Therefore, by removing a plate position adjusting device which will be described later, the rotary shaft 13 can be easily removed with the bearing metals 21 left on the main unit frames 25, thereby improving the efficiency of cleaning the impression cylinder 5.

Further, the rotary shaft 13 has the plate position adjusting device for fine adjustment of the axial position of the rotary shaft 13 and its rotational phase relative to the impression cylinder 5. A disk 31 is mounted at one end of the rotary shaft 13 (left end in FIG. 3) through a bracket 29, and an axial adjusting shaft 33 is connected unmovably in the axial direction but rotatably to the rotary shaft 13 through thrust bearings 32 disposed at both sides of the disk 31. The axial adjusting shaft 33 is screwed in a nut 37 of a supporting frame 35 fixed to the main unit frame 25, and is normally fixed to the supporting frame 35 with a lock nut 39. A knob 41 is provided at the end of the axial adjusting shaft 33. With the lock nut 39 loosened, the knob 41 can be turned to rotate the axial adjusting shaft 33 and move it forward and reverse, which is screwed in with the nut 37, thereby transmitting the movement to the rotary shaft 13 through the disk 31 to move the rotary shaft 33 axially. Thus, the axial position of the rotary shaft 13 is adjusted.

A spur gear 43 is mounted at the other end of the rotary shaft 13 (right end in FIG. 3), which engages with an internal spur gear 47 provided in a drive gear member 45. The drive gear member 45 engaged with the spur gear 43 can be moved relatively in the axial direction together with the spur gear 43. A helical gear 49 is provided on the outer periphery of the drive gear member 45, and the helical gear 49 engages with an impression cylinder gear which is not shown. Thus, rotation of the impression cylinder 5 is transmitted to the drive gear member 45 through the helical gear 49 which, through the spur gear 43, further rotates the rotary shaft 13 in synchronization with the impression cylinder 5. The drive gear member 45 is mounted with a disk 51, and connected with a circumferential adjusting shaft 55 through a thrust bearing 53 similarly to the construction of the left end of the rotary shaft 13. The circumferential adjusting shaft 55 is screwed with a nut 59 of a supporting frame 57 mounted on the main unit frame 25 and normally fixed to the supporting frame 57 with a lock nut 61. With the lock nut 61 loosened, a knob 63 which is provided at the end of the circumferential adjusting shaft 55 can be turned to rotate the circumferential adjusting shaft 55 and move it forward and reverse in the axial direction, thereby moving the drive gear member 45 in the axial direction. The axial movement of the drive gear member 45 changes the engaging phase of the helical gear 49 with the impression cylinder gear, thereby adjusting the rotational phase of the rotary shaft 13 relative to the impression cylinder 5. The movement of the rotary shaft 13 by the axial adjusting shaft 33 and the relative axial movement of the spur gear 43 and the drive gear member 45 through the movement of the drive gear member 45 by the circumferential adjusting shaft 55 are absorbed by a relative movement of the spur gear 43 and the drive gear member 45 in the gear tooth direction.

Thus, the printing position or coating position can be adjusted horizontally and vertically by the axial and circumferential movement of the rotary shaft 13. Numeral 65 in FIG. 3 indicates a cover.

Figure 4:
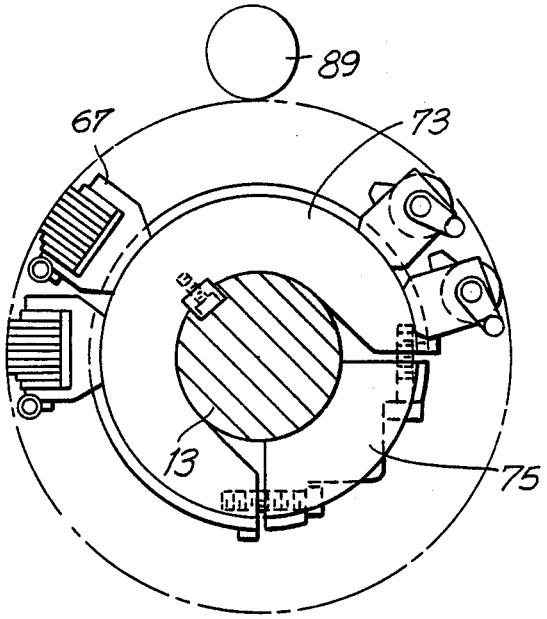
FIG. 4 and FIG. 5 are side views of a numbering device and the coating cylinder, respectively.
Figure 5:
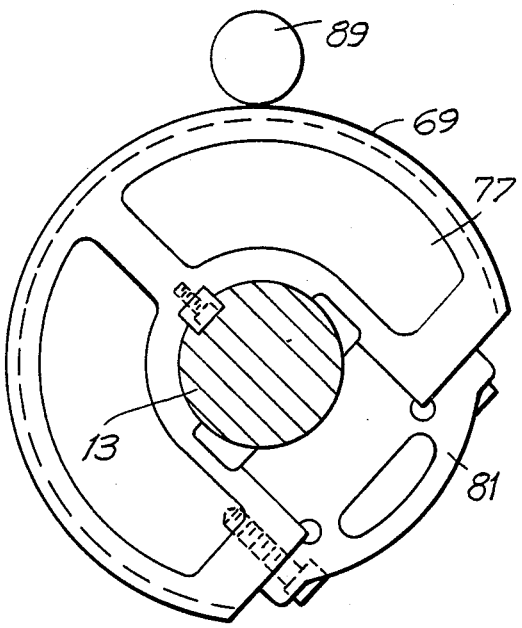
Figure 6:
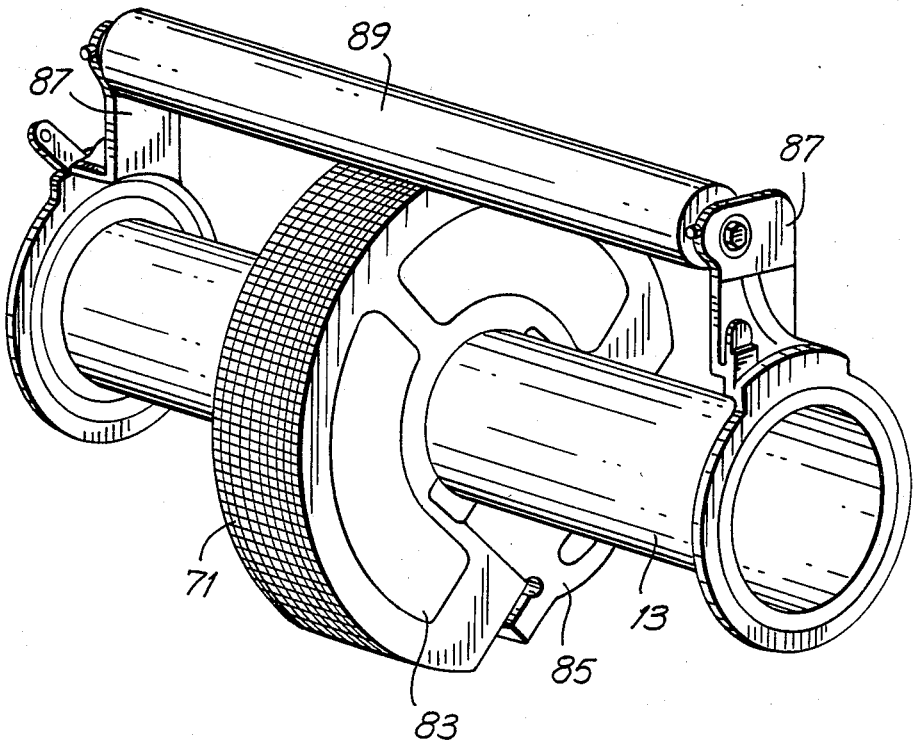
FIG. 6 is a schematic oblique view showing a relief imprinting cylinder mounted on the rotary shaft.

The rotary shaft 13 is detachably mounted alternatively with a numbering device 67 as shown in FIG. 4, a coating cylinder 69 as shown in FIG. 5, or a relief imprinting cylinder 71 as shown in FIG. 6. FIG. 3 shows the rotary shaft 13 mounted with the coating cylinder 69. Each of the numbering device 67, the coating cylinder 69, and the relief imprinting cylinder 71 is cut out of part of its circumference so that it can be mounted and detached from the peripheral surface of the rotary shaft 13, and the cutout can be detachably mounted with a cap. Referring to FIG. 4, the numbering device 67 is mounted on a mount 73 having a cutout which allows the rotary shaft 13 to pass, so that the position of the numbering device 67 can be circumferentially adjusted. The mount 73 can be mounted at any axial position on the rotary shaft 13 so that the rotary shaft 13 is placed between the mount 73 and a cap 75. Referring to FIG. 5, the coating cylinder 69 comprises a mount 77 with a partial cutout and a resin sheet stuck on the outer peripheral surface of the mount 77, and is detachably mounted on the rotary shaft so that the rotary shaft 13 is pinched between the mount 77 and a cap 81 in the case of the numbering device 67. The sheet on the surface of the coating cylinder 69 is provided on a part corresponding to that to be coated. For example, to coat the overall surface of a sheet, the sheet is provided on the overall surface of the coating cylinder 69, or for coating partly, the sheet is provided only on the corresponding part of the surface of the coating cylinder 69. Similarly, as shown in FIG. 6, the relief imprinting cylinder 71 can be detachably mounted on the rotary shaft 13 using a mount 83 and a cap 85. Thus, one of the numbering device 67, the coating cylinder 69, and the relief imprinting cylinder 71 is alternatively mounted on the rotary shaft 13 as needed.

As shown in FIG. 3, on the eccentric bushings 23 at both ends of the rotary shaft 13 bosses of levers 87 are mounted. Rotational centers of the levers 87 are aligned with the centers of inner peripheral arcs of the eccentric bushings 23, that is the rotational center of the rotary shaft 13. An application roller 89 is detachably mounted between the ends of the levers 87 so that the application roller 89 extends in parallel to the rotary shaft 13 and is in rotatable contact with the outer peripheral surface of the numbering device 67, the coating cylinder 69, or the relief imprinting cylinder 71 mounted on the rotary shaft 13. The application roller 89 is replaced at the same time the ink unit 17 and the coater unit 19 are replaced. The application roller 89 for ink is used for numbering or imprinting operation, or the application roller 89 for coating material is used for coating operation.

The bosses of the levers 87 have projecting mounting pieces 91. Springs 93 are stretchedly provided between the mounting pieces 91 and the main unit frames 25, and the stretching force of the springs 93 urges the levers 87 counter-clockwise in FIG. 2. The levers 87 are mounted with swing claws 95, and the swing claws 95 detachably hook on hooking pieces 99 which are projectingly provided on supporting bars 97 mounted on the main unit frames 25, thereby restricting rotation of the levers 87 due to the springs 93.

Figure 2:
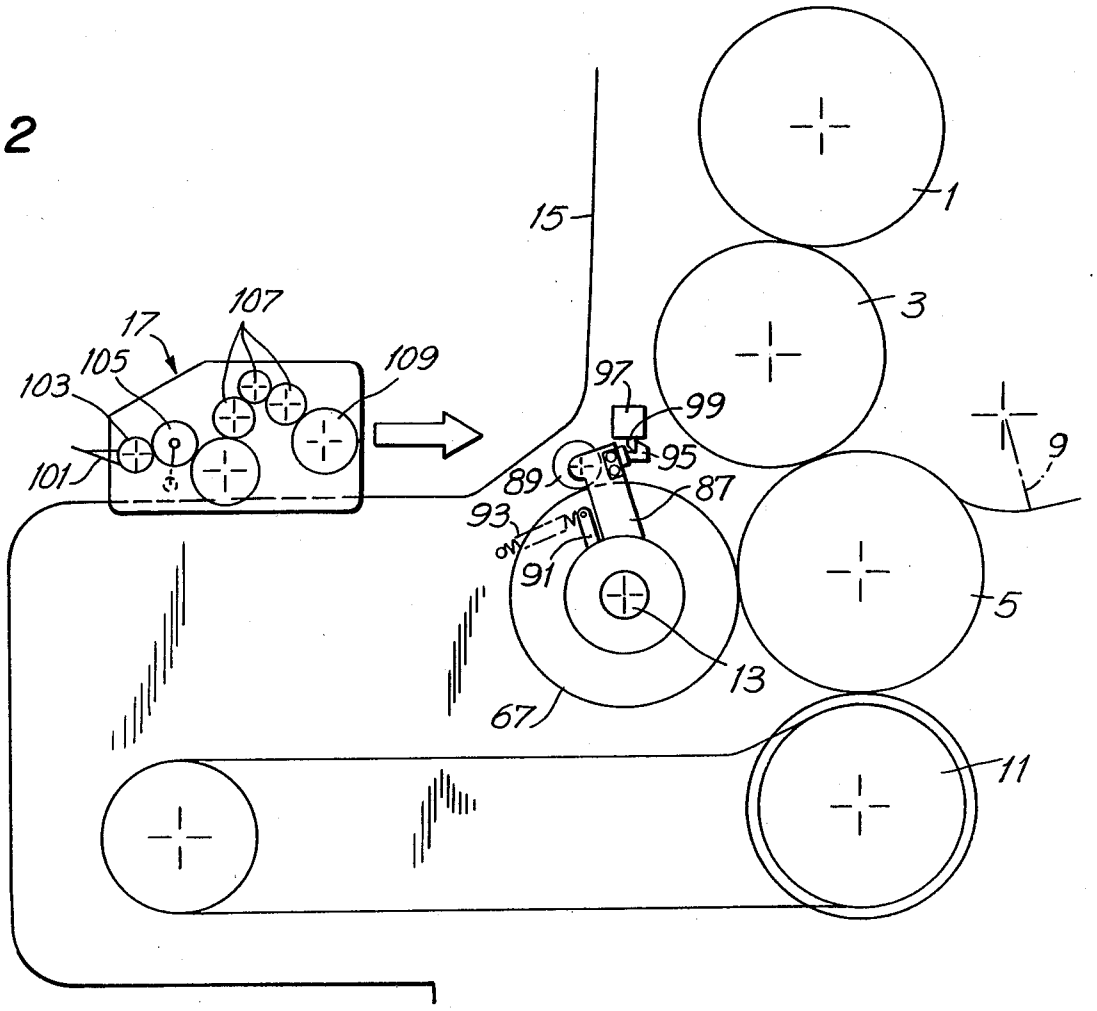
FIG. 2 is a schematic view showing part of the embodiment of the sheet-feed offset printing apparatus shown in FIG. 1.

Referring to FIG. 1 and FIG. 2, the ink unit 17 has an ink bottle 101, a bottle roller 103, a transfer roller 105, an intermediate leveling roller 107, and a leveling roller 109 which contacts with the application roller 89. The ink unit 17 is detachably mounted, using a conventional method known in the art, on an opening of the printing apparatus main unit 15 provided opposing the application roller 89. With the ink unit 17 mounted, the leveling roller 109 contacts with the ink application roller 89, and the rollers 89 and 109 are pressed against each other with an adequate nip pressure provided by the springs 93. The ink unit 17 also has a drive gear mechanism (not shown) for these rollers 101, 103, 107, and 109, and is driven by the drive gear mechanism which engages with a gear 111 (see FIG. 3) mounted on the rotary shaft 13 when the ink unit 17 is installed on the printing apparatus main unit 15.

As shown in FIG. 7 showing schematically the printing apparatus according to the present invention which is ready for coating operation, the coater unit 19 has a varnish boat 113, a pick-up roller 115 which is partly dipped in the varnish boat 113, and a metering roller 117 which contacts with the application roller 89 for coating material mounted on the printing apparatus main unit 15, and is detachably mounted on the printing apparatus main unit 15 as in the case of the ink unit 17. With the coater unit installed on the printing apparatus main unit 15, the metering roller 117 is pressed against the application roller 89 with an adequate pressure by the urging force of the springs 93, and a drive gear mechanism (not shown) in the coater unit 19 engages with the gear 111 as in the case of the ink unit 17.

For performing a numbering operation with the above-described arrangement, the numbering device 67 is mounted on the rotary shaft 13 and the ink unit 17 on the printing apparatus main unit 15, as shown in FIG. 1 and FIG. 2. Ink is supplied from the leveling roller 109 to the numbering device 67 through the ink application roller 89, and number printing is made on paper to be printed which is inserted between the numbering device 67 and the impression cylinder 5. For imprinting, the relief imprinting cylinder 71 is mounted on the rotary shaft 13 in place of the numbering device 67 as shown in FIG. 6, and other operations are the same as for the numbering operation.

For a coating operation, the coating cylinder 69 is mounted on the rotary shaft 13 and the coater unit 19 is mounted on the printing apparatus main unit 15 as shown in FIG. 7. A coating material such as varnish is supplied from the metering roller 117 to the coating cylinder through the application roller 89 for coating material, and coated on paper to be printed which is inserted between the coating cylinder 69 and the impression cylinder 5. A conveyer belt 119 is disposed beneath the sheet discharger 11, and a coated sheet discharged from the sheet discharger 11 is carried by the conveyer belt 119 to a dryer 121 where the sheet is dried and then put into a pile 123. The coating position is adjusted by the plate position adjusting device.

Since, in the above-described embodiment according to the present invention, the numbering device 67, the application roller 89 which contacts directly with the coating cylinder 69, or the relief imprinting cylinder 71 is disposed on the printing apparatus main unit 15, a constant nip pressure between the application roller 89 and the numbering device 67, the coating cylinder 69, or the relief imprinting cylinder 71 is achieved irrespective of movement of the rotary shaft 13, the ink unit 17 or the coater unit 19. Therefore, the nip pressure is unnecessary to be adjusted even when the ink unit 17 or the coater unit 19 is inserted in place of another unit, and an adequate amount of ink or coating material can always be maintained. In the present invention, the application roller 89 which contacts directly with the numbering device 67, the coating cylinder 69, or the relief imprinting cylinder 71 can be alternatively provided on the side of the ink unit 17 or coater unit 19. In some cases, the plate position adjusting device can be omitted.

As described in detail above, the embodiment of the present invention uses the integral rotary shaft which can be easily supported at a high precision, which enables numbering, imprinting and coating operations by a single printing apparatus, thereby reducing the equipment cost and installation space.

I claim:

1. A printing apparatus having a coating function comprising an integral rotary shaft disposed adjacent to an impression cylinder, supported at both ends within apertures in a main unit frame means and driven to rotate synchronously with said impression cylinder, said main frame means comprising two integral main frame members each of which has an aperture therein and wherein said rotary shaft is supported at its both ends through said apertures, a numbering device, a relief imprinting cylinder, and a coating cylinder alternatively mounted detachably on said rotary shaft, an ink unit detachably mounted on a printing apparatus main unit for supplying ink to said numbering device or said relief imprinting cylinder, and a coater unit detachably mounted alternatively to said ink unit on said printing apparatus main unit for supplying a coating material to said coating cylinder, said outer diameter of said rotary shaft being smaller than the inner diameter of said apertures of said frame means, said frame means including bearing metals and wherein said rotary shaft is supported at its both ends by said bearing metals, the central part of said rotary shaft intermediate its both ends which are supported by said bearing metals has a diameter which is smaller than an inner diameter of at least one of said bearing metals thereby enabling the removal of said rotary shaft in the axial direction without removing said bearing metals from said main unit frame means.

2. A printing apparatus having a coating function as claimed in claim 1, wherein each of said numbering device, said relief imprinting cylinder, and said coating cylinder comprises a continuous ring-shaped mount having a cutout on part of its circumference so as to allow said rotary shaft to pass through, and a cap detachably mounted on said cutout of said mount for supporting said rotary shaft between said cap and said mount.

3. A printing apparatus having a coating function as claimed in claim 2, wherein an application roller for ink rotatably contacting an outer peripheral surface of said numbering device or said relief imprinting cylinder mounted on said rotary shaft is detachably mounted parallel to said rotary shaft in said printing apparatus main unit, and said ink unit has a leveling roller rotatably contacting said outer peripheral surface of said application roller for supplying said application roller with ink.

4. A printing apparatus having a coating function as claimed in claim 2, wherein an application roller for coating material rotatably contacting with the outer peripheral surface of said coating cylinder mounted on said rotary shaft is detachably mounted parallel to said rotary shaft in said printing apparatus main unit, and said coater unit has a metering roller rotatably contacting with the outer peripheral surface of said application roller for coating material for supplying said application roller with coating material.

5. A printing apparatus having a coating function comprising a single rotary shaft means disposed adjacent to an impression cylinder, supported at both ends within apertures in a main unit frame means and driven to rotate synchronously with said impression cylinder, said main frame means comprising two integral main frame members each of which has an aperture therein and wherein said rotary shaft is supported at its both ends through said apertures, a numbering device, a relief imprinting cylinder, and a coating cylinder alternatively mounted detachably on said rotary shaft, an ink unit detachably mounted on a printing apparatus main unit for supplying ink to said numbering device or said relief imprinting cylinder, and a coater unit detachably mounted alternatively to said ink unit on said printing apparatus main unit for supplying a coating material to said coating cylinder, said outer diameter of said single rotary shaft being smaller than the inner diameter of said apertures of said frame means, said frame means including bearing metals and wherein said rotary shaft is supported at its both ends by said bearing metals, the central part of said rotary shaft intermediate its both ends which are supported by said bearing metals has a diameter which is smaller than an inner diameter of at least one of said bearing metals thereby enabling the removal of said rotary shaft in the axial direction without removing said bearing metals from said main unit frame means.

* * * * *